US010422145B1

(12) United States Patent
Rice

(10) Patent No.: US 10,422,145 B1
(45) Date of Patent: Sep. 24, 2019

(54) ERGONOMIC DRYWALL HAWK

(71) Applicant: Valerie D. Rice, Lakelands (CA)

(72) Inventor: Valerie D. Rice, Lakelands (CA)

( * ) Notice: Subject to any disclaimer, the term of this patent is extended or adjusted under 35 U.S.C. 154(b) by 266 days.

(21) Appl. No.: 15/458,230

(22) Filed: Mar. 14, 2017

Related U.S. Application Data

(60) Provisional application No. 62/307,920, filed on Mar. 14, 2016.

(51) Int. Cl.
*E04F 21/16* (2006.01)
*E04F 21/165* (2006.01)

(52) U.S. Cl.
CPC ..... *E04F 21/161* (2013.01); *E04F 21/165* (2013.01)

(58) Field of Classification Search
CPC ..... E04F 21/16; E04F 21/161; E04F 21/165; E04F 21/1652
See application file for complete search history.

(56) References Cited

U.S. PATENT DOCUMENTS 832,036 A * 10/1906 Bunker ..... E04F 21/06 294/3.5
963,143 A * 7/1910 Hansen ..... E04F 21/06 294/3.5
1,348,516 A 8/1920 Peck
1,691,777 A * 11/1928 Mayes ..... E04F 21/06 15/235.4
1,773,437 A * 8/1930 Riege ..... E04F 21/06 294/3.5
1,865,885 A 7/1932 Byhre
2,535,726 A 12/1950 Dalton
2,821,078 A * 1/1958 Steward ..... E04F 21/06 222/409
3,790,201 A 2/1974 Morsilli
4,753,471 A 6/1988 Gringer
5,067,761 A 11/1991 Blowers
5,186,507 A 2/1993 Neidfeld
6,044,516 A 4/2000 Lev
6,425,952 B1 7/2002 Krapivner
7,425,027 B2 9/2008 Carney
8,205,289 B1 6/2012 Croft
D716,122 S * 10/2014 Bingham ..... D8/45
2004/0150236 A1 8/2004 Hobel et al.
2006/0032009 A1* 2/2006 Cheney ..... E04F 21/06 15/235.4

(Continued)

FOREIGN PATENT DOCUMENTS

EP 0141482 A2 5/1985

OTHER PUBLICATIONS

Trowels and Floats | Aluminum Hawks. Product Listing [online]. Grip Tight Tools 2011. [Retrieved on Sep. 12, 2014.] <URL: http://www.griptighttools.com/trowels-and-floats-discount-6/aluminium-hawks-cheap-35/>.

(Continued)

*Primary Examiner* — Randall E Chin
(74) *Attorney, Agent, or Firm* — Cramer Patent & Design, PLLC; Aaron R. Cramer

(57) ABSTRACT

An ergonomic drywall hawk used to provide staging of drywall joint compound, provides enhanced ergonomic features. The hawk includes a flat upper surface plate having a subjacent horizontal handle in lieu of a conventional vertical handle. The horizontal handle provides improved hand and wrist positioning resulting in reduced risk of wrist or hand pain or other ergonomic injuries.

18 Claims, 5 Drawing Sheets

(56) References Cited

U.S. PATENT DOCUMENTS

2007/0080268 A1 4/2007 Worrell

OTHER PUBLICATIONS

13"×13" Aluminum Ergonomic Drywall Hawk. Product Listing [online]. 2013 Home Hardware Stores Limited. [Retrieved on Dec. 9, 2014.] <URL:http://www.homehardware.ca/en/rec/index.htm/Tools/Hand-Tools/Drywall-Floor/Drywall-Plaster/Hawks/13-x-13-Aluminum-Ergonomic-Drywall-Hawk/_/N-ntm0k/R-I1078472?Num=1>.

* cited by examiner

ERGONOMIC DRYWALL HAWK

RELATED APPLICATIONS

This application is a Continuation-in-part and claims the benefit of U.S. Provisional Application No. 62/307,920 which was filed Mar. 14, 2016, the entire disclosures of which are incorporated herein by reference.

FIELD OF THE INVENTION

The present invention relates to a drywall hawk having an ergonomic shape.

BACKGROUND OF THE INVENTION

As anyone who performs a lot of physical work will attest, nothing beats having the proper tool for a job. The proper tool can save time, save money, produce a higher quality job, reduce damage to equipment, and provide for the increased safety of the worker. Each field of skilled trade work has its own type of specialty tools, each performing a specialized task. One (1) tool used in dry walling work is that of the drywall hawk. The drywall hawk comprises a plate that holds a drywall compound or spreadable material on top and a perpendicular handle on the bottom located at its center point. This allows the drywall worker to quickly apply drywall compound to the wall without returning to a central location whenever more drywall compound is needed. However, one (1) disadvantage of a drywall hawk is that the entire weight of the hawk, along with the contained compound, must be supported by the user's hand. This obviously places a great deal of stress on the hand and wrist muscles and may often result in repetitive stress injuries forcing the need for frequent rest and reduced productivity. Accordingly, there exists a need for a means by which the functionality of a drywall hawk can be provided without the risk of ergonomic injuries as described above. The development of the present invention fulfills this need.

SUMMARY OF THE INVENTION

The principles of the present invention provide for a spreadable material application tool comprising a working member which has a working member top surface, a working member bottom surface, a working member first side, a working member second side, a working member third side and a working member fourth side and a handle which is affixed to the working member bottom surface. The working member top surface provides a planar surface for retaining a quantity of spreadable material when the tool is in an upright and resting position upon a surface. A separate embodiment of the tool may also comprise of a support assembly.

The support assembly may be secured to the working member bottom surface and comprise a support assembly first side which is secured subjacent to the working member first side while having a support assembly first side first end and a support assembly first side second end, a support assembly second side which is secured subjacent to the working member second side while having a support assembly second side first end and a support assembly second side second end, a support assembly third side which is secured subjacent to the working member third side while having a support assembly third side first end and a support assembly third side second end and a support assembly fourth side which is secured subjacent to the working member fourth side while having a support assembly fourth side first end and a support assembly fourth side second end. The support assembly first side second end is secured at a right angle to the support assembly second side first end. The support assembly second side second end is secured at a right angle to the support assembly third side first end. The support assembly third side second end is secured at a right angle to the support assembly fourth side first end. The support assembly fourth side second end is secured at a right angle to the support assembly first side first end. The support assembly supports the working member in an elevated position in the upright and resting position upon the surface.

The handle may be secured between opposite corners of the support assembly spanning a distance therebetween. The support assembly may be substantially rectangular. The tool may also comprise of at least two (2) legs which are removably affixed to a bottom portion of the support assembly.

The bottom portion of the support assembly may be provided with a plurality of apertures while a top portion of each of the legs is provided with a connector to removably affix each leg to an individual one of the plurality of apertures. The working member may also be rounded or substantially rectangular. The corners of the working member may also be rounded while the perimeter edges of the handle may likewise be rounded.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
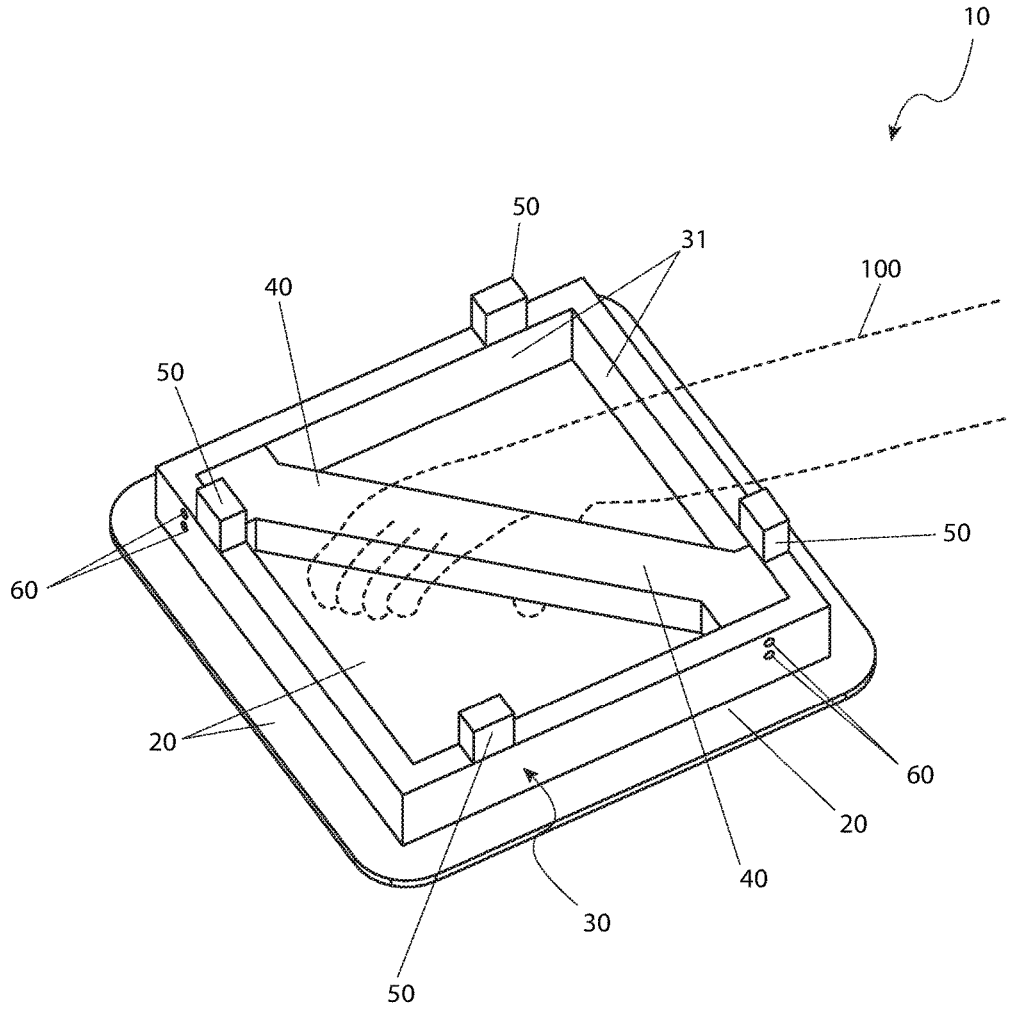
FIG. 1 is a bottom perspective view of an ergonomic drywall hawk 10 depicting an in-use state, according to a preferred embodiment of the present invention.

10 ergonomic drywall hawk
20 working surface plate
30 support assembly
31 support wall structure
32 threaded aperture
40 handle
50 removable leg
51 threaded connector
60 fastener
100 user
110 spreadable material
115 surface

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

The present invention describes an ergonomic drywall hawk (herein described as the "device") 10, which provides a drywall joint compound holding tool, known in the trade as a "hawk", having enhanced ergonomic features. The device 10 is envisioned to have overall dimensions of approximately twelve inches (12 in.) in width and thirteen inches (13 in.) in length, and two-and-a-half inches (2½ in.) in depth. The device 10 includes a horizontal flat upper working surface plate 20 which supports a quantity of spreadable material 110 during use, similar to that of a conventional drywall hawk. However, in lieu of a vertical type gripping handle, as utilized upon a conventional hawk, the device 10 includes a horizontal handle 40 which provides improved hand and wrist positions and a more comfortable usage experience, thereby resulting in reduced risk of wrist or hand pain or other ergonomic injuries. While described herein as a drywall joint compound holding tool, the device 10 could equally be employed for a similar use e.g., grout, wall patch, or other cementitious material.

Referring now to FIG. 1, a bottom perspective view of the device 10 depicting an in-use state, according to the preferred embodiment of the present invention, is disclosed. The device 10 is designed so that the support assembly 30 rests comfortably on the forearm of a user 100 during use, allowing the weight of the device 10 to be supported primarily by the forearm of the user 100 instead of the hand of the user 100. The device 10 allows the user 100 to comfortably grip the handle 40 using one (1) hand for added support and control of the device 10. The device 10 provides a plurality of removable legs 50 which allow the user 100 to easily pick up the device 10 for normal use, and set the device 10 down upon a bench, floor, or other flat surface 115 without disturbing a quantity of spreadable material 110 located upon the working surface plate 20. The removable legs 50 may be removed, if desired, for tasks which do not require the device 10 to be periodically set down (see FIG. 3).

Figure 2:
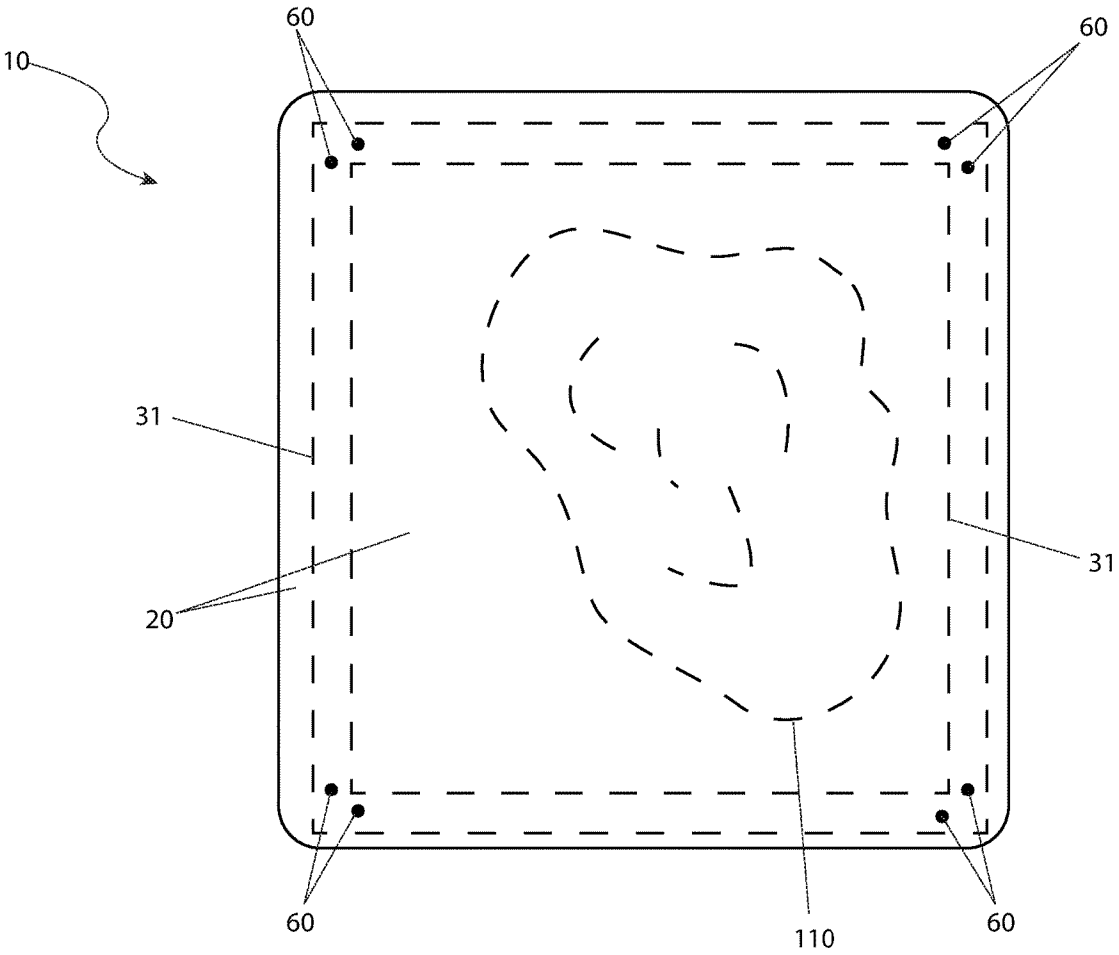
FIG. 2 is a top view of the drywall hawk 10, according to a preferred embodiment of the present invention.
Figure 3:
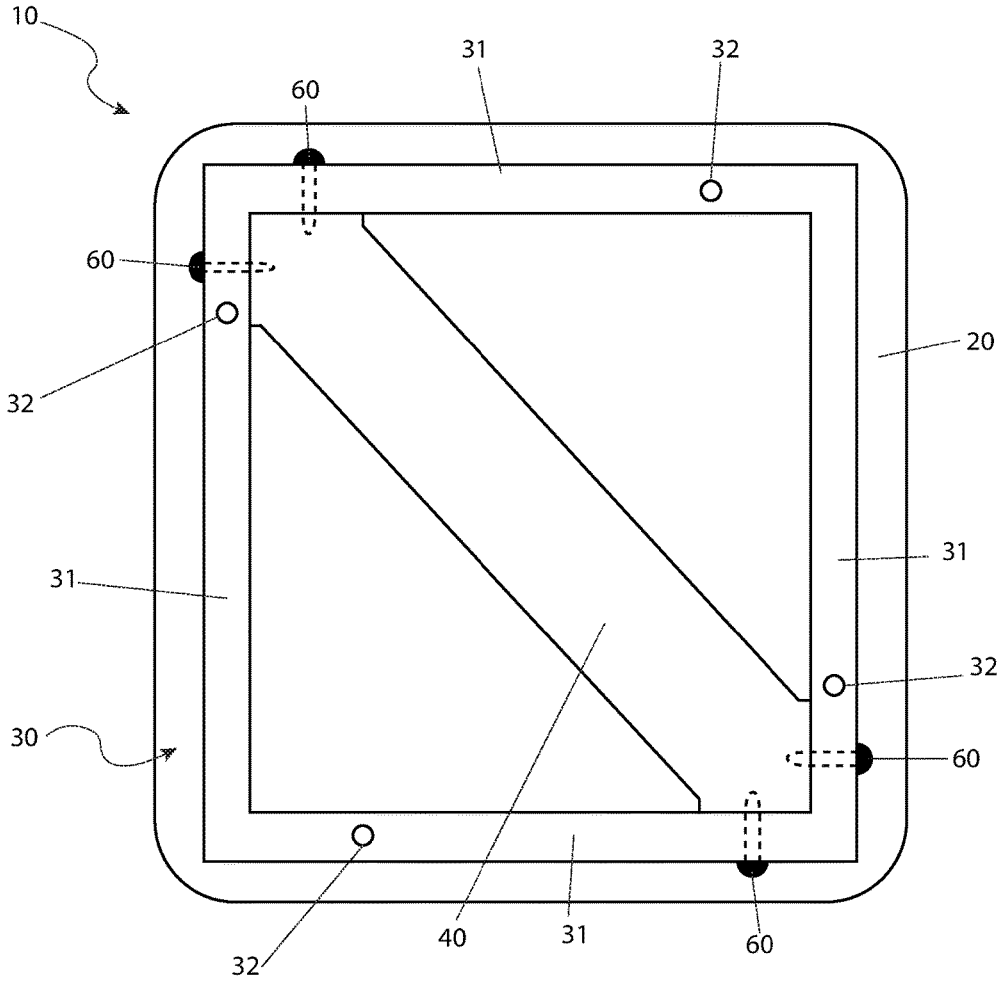
FIG. 3 is a bottom view of the drywall hawk 10, according to a preferred embodiment of the present invention.
Figure 4:
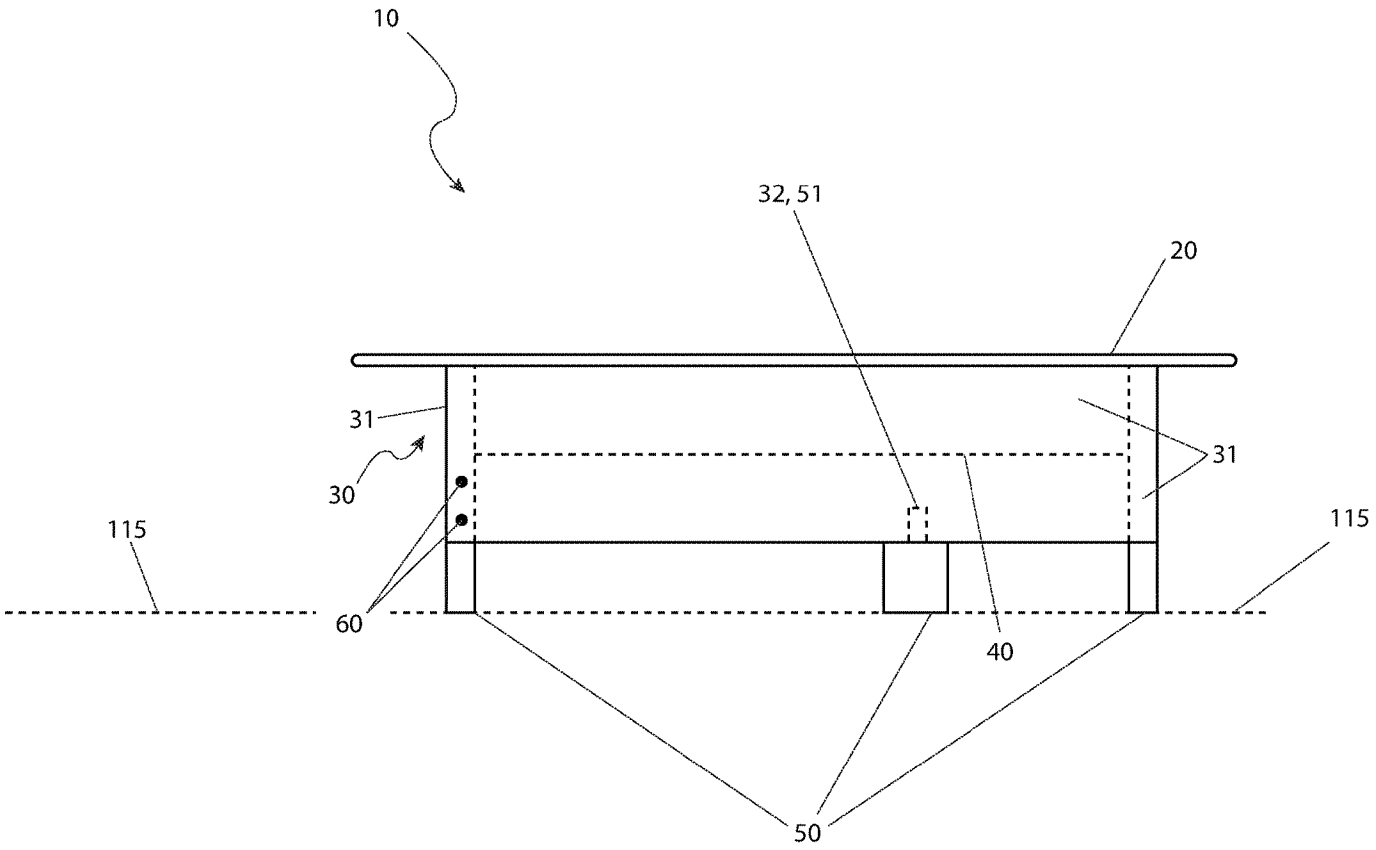
FIG. 4 is a side view of the drywall hawk 10, according to a preferred embodiment of the present invention; and, FIG. 5 is a perspective view of a removable leg portion 50 of the drywall hawk 10, according to a preferred embodiment of the present invention.

Referring now to FIGS. 2, 3, and 4, top, bottom, and side views of the device 10, according to the preferred embodiment of the present invention, are disclosed. The working surface plate 20 is approximately twelve inches (12 in.) in width and thirteen inches (13 in.) in length. Subjacent to the working surface plate 20 is a support assembly 30, affixed to the bottom surface of the working surface plate 20 using a plurality of fasteners 60, such as screws. The fasteners 60 connecting the working surface plate 20 to the support assembly 30 are located near the corners of the working surface plate 20. The support assembly 30 includes a support wall structure 31, the handle 40, and the removable legs 50. The support wall structure 31 is a four-sided rectangular shape with square corner portions being indented slightly from a perimeter edge portion of the working surface plate 20. The overall dimensions of the support wall structure 31 are approximately eleven-and-a-half inches (11½ in.) in width and twelve-and-a-half inches (12½ in.) in length. The cross-sectional dimensions of the support wall structure 31 are approximately one inch (1 in.) in width and two inches (2 in.) in depth.

The handle 40 extends diagonally between opposing inner corners of the support wall structure 31. The handle 40 is positioned in such a way that the bottom surface of the handle 40 is flush with the bottom surface of the support wall structure 31, thereby creating a gap above the handle 40 for the user 100 to insert their fingers during use. The handle 40 is approximately two inches (2 in.) in width, one inch (1 in.) in depth, and sixteen-and-a-half inches (16½ in.) in length. The handle 40 is fastened to the two (2) corner portions of the support wall structure 31 using a plurality of fasteners 60.

The perimeter of the working surface plate 20 preferably features smooth, rounded corners. Similarly, the handle 40 is envisioned to provide smooth rounded edge portions to provide added comfort to the user 100. The portions of the device 10 are to be made using sturdy materials such as aluminum, stainless steel, resin plastic, wood, or the like.

The removable legs 50 are each removably attached to the bottom surface of the support wall structure 31 via threaded insertion of a threaded connector portion 50 of each removable leg 51 into a respective female threaded aperture portion 32 of the support wall structure 31. A bottom view of the device 10 is illustrated in FIG. 3 with the removable legs 50 removed to better illustrate the threaded aperture portions 32. In the embodiment illustrated here, one (1) threaded aperture 32 is located along each straight portion of the support wall structure 31. Each threaded aperture 32 is to be correspondingly sized and threaded so as to receive a threaded connector portion 51 of a respective removable leg 50 (see FIG. 5). The threaded apertures 32 are positioned in such a way that the attachment of the removable legs 50 thereto, will not interfere with the arm of the user 100 or the operation of the device 10, thereby providing balanced manipulation of the device 10 during use (also see FIG. 1).

Figure 5:
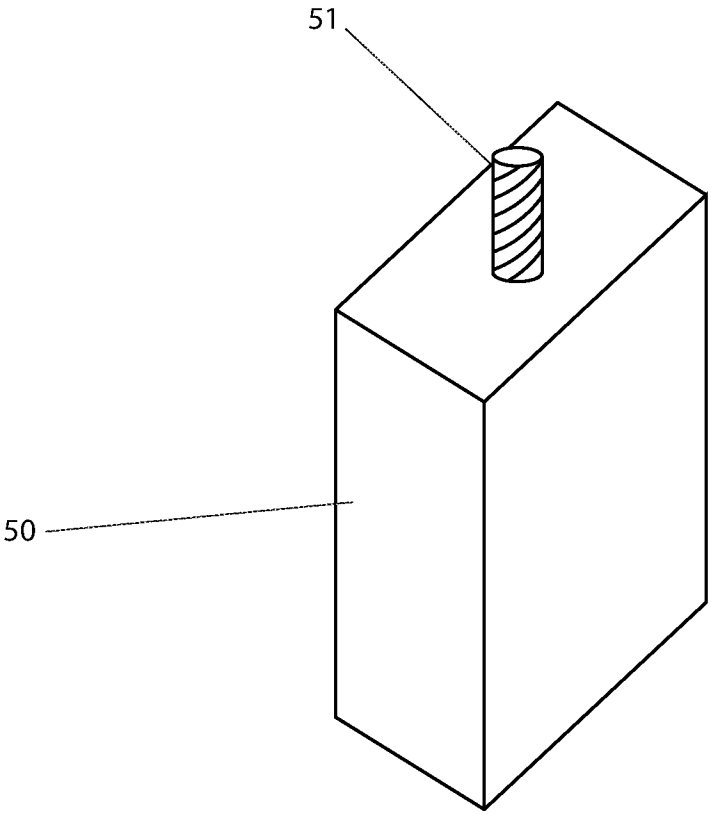

Referring now to FIG. 5, a perspective view of a removable leg 50, according to the preferred embodiment of the present invention, is disclosed. The removable leg 50 is to have approximate dimensions of one inch (1 in.) in width, one-and-a-half inches (1½ in.) in length, and two inches (2 in.) in height. A bottom surface portion of the removable leg 50 includes a protruding threaded connector 51 which provides for attachment and detachment of the removable leg 50 from a corresponding threaded aperture portion 32 of the support wall structure 31. While the device 10 is positioned upon a surface 115, and resting upon the removable legs 50, the removable legs 50 are to provide enough clearance along a bottom edge of the device 10 to allow a user 100 to reach their hand under the device 10 and grasp the handle 40 (also see FIGS. 1 and 4).

It is envisioned that other styles and configurations of the present invention can be easily incorporated into the teachings of the present invention, and only one (1) particular configuration shall be shown and described for purposes of clarity and disclosure and not by way of limitation of scope.

The method of utilizing the device 10 may be achieved by performing the following steps: procuring the device 10; placing the device 10 on the forearm of the user 100 while coincidentally grasping the handle 40 with one (1) hand of the user 100; placing a desired quantity of drywall spreadable material 110 onto the top surface of the working surface plate 20 using the remaining hand; manipulating the device 10 in a normal manner during application of the spreadable material 110 to fill drywall cracks using an appropriate existing application tool; replenishing the spreadable material 110 upon the working surface plate 20 as needed until completion of a drywall sealing project; and, benefitting from a more comfortable usage experience and reduced risk of ergonomic injuries, afforded a user of the present invention 10.

During times when the device 10 does not need to be held, the device 10 may be set upon the removable legs 50 on a surface 115. During times when the device 10 does not need to be set down, the removable legs 50 can be removed, if desired, by twisting each removable leg 50 until the threaded connector 51 is separated from the respective threaded aperture 32. The removable legs 50 can later be reattached to the device 10 by inserting the threaded connector 51 into the threaded aperture 32 and twisting the removable leg 50 until the top surface of the removable leg 50 is flush against the bottom surface of the support wall structure 31.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A spreadable material application tool comprising:

a working member comprising:

a working member top surface;

a working member bottom surface;

a working member first side;

a working member second side;

a working member third side; and, a working member fourth side;

a handle affixed to said working member bottom surface;

wherein said working member top surface is planar and capable of retaining a quantity of spreadable material when said tool is in an upright and resting position upon a surface;

further comprising a support assembly secured to said working member bottom surface comprising:

a support assembly first side secured subjacent said working member first side having a support assembly first side first end and a support assembly first side second end;

a support assembly second side secured subjacent said working member second side having a support assembly second side first end and a support assembly second side second end;

a support assembly third side secured subjacent said working member third side having a support assembly third side first end and a support assembly third side second end; and, a support assembly fourth side secured subjacent said working member fourth side having a support assembly fourth side first end and a support assembly fourth side second end;

wherein said support assembly first side second end is secured at a right angle to said support assembly second side first end;

wherein said support assembly second side second end is secured at a right angle to said support assembly third side first end;

wherein said support assembly third side second end is secured at a right angle to said support assembly fourth side first end;

wherein said support assembly fourth side second end is secured at a right angle to said support assembly first side first end; and, wherein said support assembly supports said working member in an elevated position in said upright and resting position upon said surface.

2. The tool recited in claim 1, wherein said handle is secured between opposite corners of said support assembly spanning a distance therebetween.

3. The tool recited in claim 1, wherein said support assembly is substantially rectangular.

4. The tool recited in claim 1, further comprising at least two legs removably affixed to a bottom portion of said support assembly.

5. The tool recited in claim 4, wherein:

said bottom portion of said support assembly is provided with a plurality of apertures; and, a top portion of each of said leg is provided with a connector to removably affix each leg to an individual one of said plurality of apertures.

6. The tool recited in claim 1, wherein perimeter edges of said working member are rounded.

7. The tool recited in claim 1, wherein said working member is substantially rectangular.

8. The tool recited in claim 7, wherein corners of said working member are rounded.

9. The tool recited in claim 1, wherein perimeter edges of said handle are rounded.

10. A spreadable material application tool comprising:

a working member comprising:

a working member top surface;

a working member bottom surface;

a working member first side;

a working member second side;

a working member third side; and, a working member fourth side;

a handle affixed to said working member bottom surface; and, a support assembly secured to said working member bottom surface;

wherein said working member top surface is capable of retaining a quantity of spreadable material when said tool is in an upright and resting position upon a surface;

wherein said support assembly further comprises:

a support assembly first side secured subjacent said working member first side having a support assembly first side first end and a support assembly first side second end;

a support assembly second side secured subjacent said working member second side having a support assembly second side first end and a support assembly second side second end;

a support assembly third side secured subjacent said working member third side having a support assembly third side first end and a support assembly third side second end; and, a support assembly fourth side secured subjacent said working member fourth side having a support assembly fourth side first end and a support assembly fourth side second end;

wherein said support assembly first side second end is secured at a right angle to said support assembly second side first end;

wherein said support assembly second side second end is secured at a right angle to said support assembly third side first end;

wherein said support assembly third side second end is secured at a right angle to said support assembly fourth side first end;

wherein said support assembly fourth side second end is secured at a right angle to said support assembly first side first end; and, wherein said support assembly supports said working member in an elevated position in said upright and resting position.

11. The tool recited in claim 10, wherein said handle is secured between opposite corners of said support assembly spanning a distance therebetween.

12. The tool recited in claim 10, wherein said support assembly is substantially rectangular.

13. The tool recited in claim 10, further comprising at least two legs removably affixed to a bottom portion of said support assembly.

14. The tool recited in claim 13, wherein:

said bottom portion of said support assembly is provided with a plurality of apertures; and, a top portion of each of said leg is provided with a connector to removably affix each leg to an individual one of said plurality of apertures.

15. The tool recited in claim 10, wherein perimeter edges of said working member are rounded.

16. The tool recited in claim 10, wherein said working member is substantially rectangular.

17. The tool recited in claim 16, wherein corners of said working member are rounded.

18. The tool recited in claim 10, wherein perimeter edges of said handle are rounded.

* * * * *